US005754193A

United States Patent [19]

Elhatem

[11] Patent Number: 5,754,193

[45] Date of Patent: May 19, 1998

[54] THERMAL INK JET PRINTHEAD WITH REDUCED POWER BUS VOLTAGE DROP DIFFERENTIAL

[75] Inventor: Abdul M. Elhatem, Redondo Beach, Calif.

[73] Assignee: Xerox Corporation, Stamford, Conn.

[21] Appl. No.: 370,138

[22] Filed: Jan. 9, 1995

[51] Int. Cl.[6] ..... B41J 2/05

[52] U.S. Cl. ..... 347/12; 347/57

[58] Field of Search ..... 347/12, 57, 13, 347/180, 181, 182

[56] References Cited

U.S. PATENT DOCUMENTS 4,689,694 8/1987 Yoshida ..... 356/298

5,075,701 12/1991 Arai ..... 347/182

5,089,832 2/1992 Ito et al. ..... 347/182

*Primary Examiner*—Benjamin R. Fuller

*Assistant Examiner*—Craig A. Hallacher

*Attorney, Agent, or Firm*—Nola Mae McBain

[57] ABSTRACT

An inkjet printhead addressing and firing design which minimizes voltage drop differential occurring on a power bus which supplies power to fire individual ink jets due to current loads needed to fire the individual ink jets. The voltage drop differential can be reduced in part by firing a group of individual jets which are spaced out over the entire length of the array instead of firing a group of adjacent jets. Spacing of the firing jets will insure that less than an entire amount of current needed to fire a group of jets will be needed in the center of the bus. Reducing the amount of current needed to travel the length of the bus reduces the voltage drop differential on the bus caused by current conduction along the bus.

3 Claims, 3 Drawing Sheets

THERMAL INK JET PRINTHEAD WITH REDUCED POWER BUS VOLTAGE DROP DIFFERENTIAL

BACKGROUND

This invention relates generally to thermal ink jet printheads and more particularly concerns a design which minimizes the voltage drop differential on the power bus due to current loads needed to fire individual ink jets.

A typically designed thermal ink jet printhead has an array of transducers and jets spaced at the desired printing density and electrically addressable for drop on demand printing. As the print speed and printer function requirements increase, the number of jets increases. When the number of jets is large, several issues impacting print quality occur. Some of these issues are control of the ink drop size, smile effects across the array, precise firing of the drops, overlap of the firing jets during a data cycle, and printhead lifetime.

FIG. 1 shows a typical printhead transfer function across a conventionally addressed ink jet array. The horizontal axis represents the position of an individual jet within the array. The vertical axis represents the firing voltage seen by each individual jet within the array. Curve 10 represents the actual voltages seen by the individual jets across the array. Curve 10 is higher at either end and dips in the middle which is commonly referred to as a "smile effect" across an array. Line 12 represents an ideal case, where the same voltage is seen by every jet across the array. The difference between line 12 and curve 10 at its lowest point in the center is a maximum voltage drop differential $v_{drop}$ across the array. When an individual ink jet receives substantially less voltage while it is being fired then ink drop size is adversely affected. This firing voltage drop differential is caused by the voltage drop differential across the power bus of the array.

Many of these issues can be improved by reducing the voltage drop differential on the power bus of the array while the jets are being fired. Reduction of the voltage drop differential will contribute to a decrease in the smile effect, a decrease in drop size variations, and an increase in the printhead lifetime.

The $v_{drop}$ can be reduced in part by a new architecture and addressing scheme for the ink jets in the array. In current addressing schemes, adjacent jets are addressed and fired simultaneously. Typically, four adjacent jets will require 1 ampere of current to be fired. There is however, resistance in the power bus. The 1 ampere of current traveling the length of the power bus will cause a corresponding $v_{drop}$ on the power bus as it travels the length of the power bus. The $v_{drop}$ on the power bus can therefore be reduced by firing individual jets which are spaced out over the entire length of the array instead of firing adjacent jets. Spacing of the firing jets distributes the full 1 ampere of current needed to fire four jets. Reducing the amount of current needed to travel the length of the bus reduces the $v_{drop}$ on the bus caused by the current conduction along the bus.

Accordingly, is is the primary aim of the invention to provide a thermal ink jet printhead addressing and firing design with reduced voltage drop differentials on the power bus.

Further advantages of the invention will become apparent as the following description proceeds.

SUMMARY OF THE INVENTION

Briefly stated, and in accordance with the present invention, there is provided an ink jet printhead addressing and firing design which minimizes voltage drop differential occurring on a power bus which supplies power to fire individual ink jets due to current loads needed to fire the individual ink jets. The voltage drop differential is reduced in part by firing a group of individual jets which are spaced out over the entire length of the array instead of firing a group of adjacent jets. Spacing of the firing jets distributes the amount of current needed to fire a group of jets over the entire length of the bus. Distributing the current along the length of the bus reduces the amount of current needed to travel to the center of the bus and reduces the voltage drop differential on the bus caused by current conduction along the bus.

While the present invention will be described in connection with a preferred embodiment and method of use, it will be understood that it is not intended to limit the invention to that embodiment or method of use. On the contrary, it is intended to cover all alternatives, modifications and equivalents as may be included within the spirit and scope of the invention as defined by the appended claims.

ALPHA-NUMERIC LIST OF ELEMENTS

| | |
|---|---|
| vdrop | voltage drop differential |
| 10 | Curve |
| 12 | Line |
| 20 | inkjet printhead |
| 22 | gating circuit |
| 24 | storage register |
| 26 | serial to parallel conversion register |
| 28 | line |
| 30 | data lines |
| 32 | data lines |
| 34 | clock line |
| 36 | first bank |
| 38 | second bank |
| 40 | third bank |
| 42 | fourth bank |
| 44 | 6-bit 12 state counter |
| 46 | PLA |
| 48 | decoder |
| 50 | power circuit |
| 52 | line |
| 54 | clock circuit |
| 56 | data lines |
| 60 | jet |
| 62 | jet |
| 64 | jet |
| 66 | jet |
| 68 | jet |
| 70 | jet |
| 72 | jet |
| 74 | jet |
| 76 | jet |
| 78 | jet |
| 80 | jet |
| 82 | jet |
| 84 | jet |
| 86 | jet |
| 88 | jet |
| 90 | jet |
| 92 | 12 bit wide data bus |
| 94 | 12 bit wide data bus |
| 96 | line |

-continued

| ALPHA-NUMERIC LIST OF ELEMENTS | |
|---|---|
| 100 | line |
| 102 | line |
| 104 | line |
| 106 | line |
| 108 | line |
| 110 | line |
| 112 | line |
| 114 | line |
| 116 | line |
| 118 | line |
| 120 | line |
| 122 | line |
| 124 | line |
| 126 | line |
| 128 | line |
| 130 | line |

DETAILED DESCRIPTION OF THE INVENTION

Figure 2:
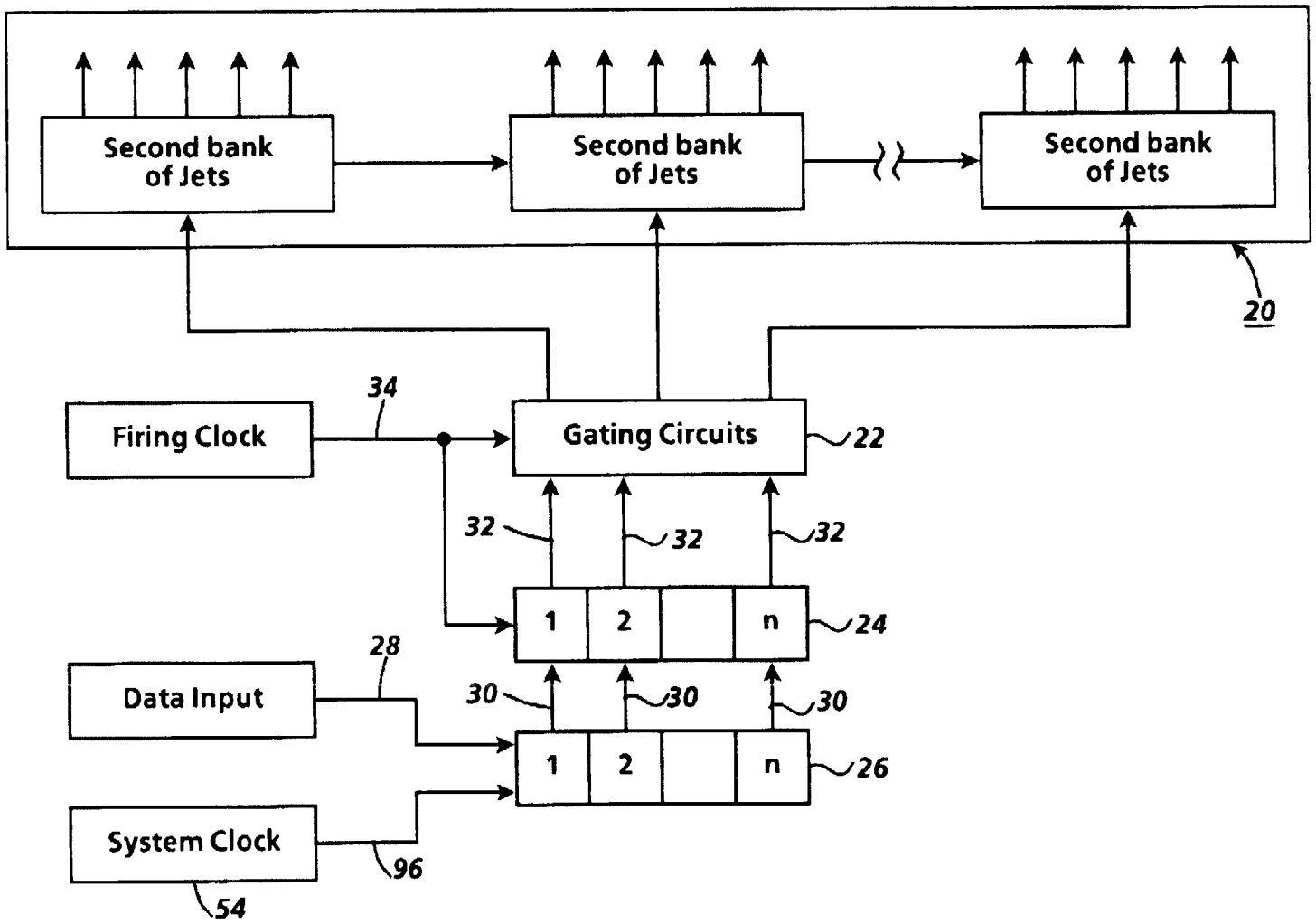
FIG. 2 shows a block diagram of a printhead addressing architecture.

Turning now to FIG. 2, a block diagram of an inkjet printhead 20 and a gating circuit 22, a storage register 24, and a serial to parallel conversion register 26 is shown. The inkjet printhead 20 contains an N number of jets. The N number of jets can be any number but a typical value would be 192. The N number of jets is divided into an M number of banks. The M number of banks must be a number which evenly divides into the N number of jets. For example if the N number of jets is 256, the M number of banks could be 4, 8, or 48 as 192 is evenly divisible by all of these numbers. There are other numbers which 192 is evenly divisible by and the M number of banks could be any one of those numbers. The number of jets in each of the M number of banks is the N number of jets divided by the M number of banks. For example, if the N number of jets is 192 and the M number of banks is 4 then each bank must have 48 jets. If the N number of jets is 192 and the M number of banks is 8 then each bank must have 24 jets.

The storage register 24 and the serial to parallel conversion register 26 each holds an n number of data bits. The n number of data bits in each of the storage register 24 and the serial to parallel conversion register 26 is determined by the N number of jets, the M number of banks, and the operation of the gating circuit 22.

The serial to parallel conversion register 26 receives serial print data on data input line 28 and the clock circuit 54 provides a clock signal on line 96 to convert the serial data to parallel data. In this diagram, a single data input line 28 is shown providing serial data input to the serial to parallel conversion register 26; however, the design is not dependent on serial to parallel data conversion. If parallel data is available, then alternatively the serial to parallel conversion register 26 could be a parallel register with the data input line 28 as an n number of bits of data wide data bus providing parallel input to the serial to parallel conversion register 26. After the serial to parallel conversion register 26 has received the n number of bits of data, the n number of bits of data is transferred to the storage register 24 through data lines 30 and using the clock line 34. The data lines 30 are a data bus that is n bits wide corresponding to the n number of data bits held by the storage register 24 and the serial to parallel conversion register 26. The storage register 24 hold the n number of bits of data and provides it to the gating circuit 22 along data lines 32. The data lines 32, are like the data lines 30, a data bus that is n bits wide corresponding to the n number of data bits held by the storage register 24 and the serial to parallel conversion register 26.

The gating circuit 22 receives not only the n number of bits of data from the storage register 24 but also a firing clock input on clock line 34. The gating circuit 22 takes the n number of bits of data and the firing clock input and selects a number of non-adjacent jets from the N number of jets to be fired and then fires the selected jets. Any scheme for choosing which non-adjacent jets will be fired can be used but one simple scheme is to choose one jet from each of the M number of banks in a sequential order.

Figure 3:
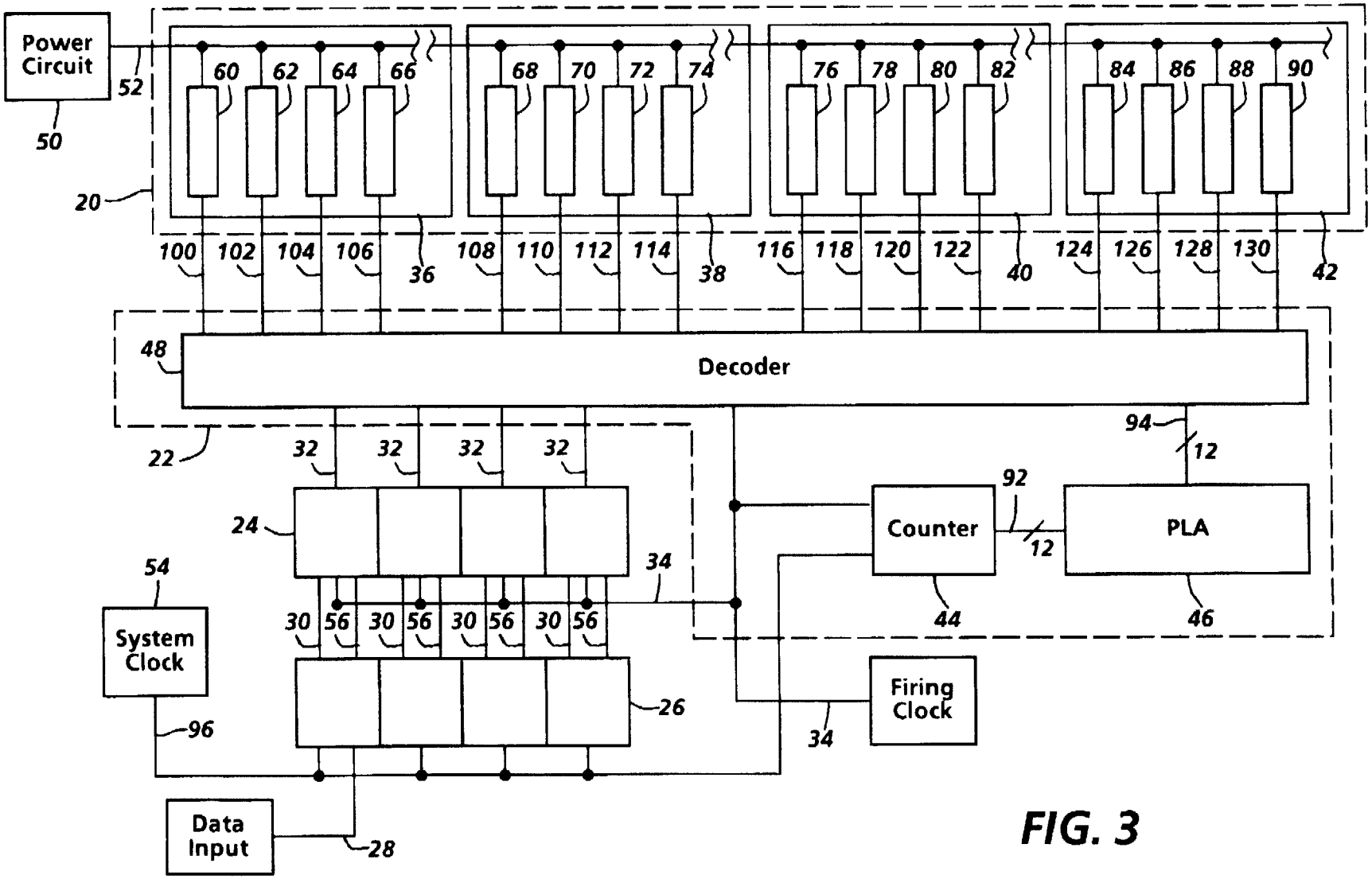
FIG. 3 shows a more detailed block diagram of the printhead addressing architecture shown in FIG. 2.

FIG. 3 shows a block diagram illustrating the implementation of the concept of choosing one jet from each of the M number of banks in a sequential order. In this example, the ink jet printhead 20 contains 192 jets divided into 4 banks of 48 jets each, a first bank 36, a second bank 38, a third bank 40, and a fourth bank 42. The gating circuit 22 comprises a 6-bit 12 state counter 44, a programmable logic array (PLA) 46, and a decoder 48. A power circuit 50 and a clock circuit 54 are also shown. The power circuit 50 provides power to the inkjet printhead 20 through line 52. Even though each bank has 48 ink jets, only the first four jets of each bank are shown, for simplicity in the figure. The first bank 36 shows jet 60, jet 62, jet 64, and jet 66. The second bank 38 shows jet 68, jet 70, jet 72, and jet 74. The third bank 40 shows jet 76, jet 78, jet 80, and jet 82. the fourth bank 42 shows jet 84, jet 86, jet 88, and jet 90.

The 6-bit 12 state counter 44 of the gating circuit 22 receives two inputs, one is the firing clock input on clock line 34 and the other is from the clock circuit 54 on line 96. The 6-bit 12 state counter 44 uses these two inputs to sequentially count through 12 different states. The first state is represented by the 6 bits 000000. The second state is represented by the 6 bits 000001. The counting continues until 12 states have been counted through by the 6-bit 12 state counter 44. The inverse of the first state is represented by the 6 bit binary number 111111. The inverse of the second state is represented by the 6 bits 111110. Each state and its inverse is provided to the PLA 46 and from the 6-bit 12 state counter 44 by a 12 bit wide data bus 92.

The PLA 46 takes the count received along the 12 bit wide data bus 92 and uses it to determine which of the jets in the inkjet printhead 20 may be enabled for firing and passes that information to the decoder 48 along a 12 bit wide data bus 94. The 6-bit 12 state counter 44 and the PLA 46 work together to provide 12 different states to the decoder 48 which will determine which individual jets may be enabled for firing. Decoding and firing of the jets is done by the decoder 48 using information received from the PLA 46 along the 12 bit wide data bus 94, along with the firing clock information along the clock line 34, and the data from the storage register 24 along the data lines 32.

One way to construct the decoder 48 is to perform a "NOR" function of several of these inputs to the decoder 48 for each jet in the ink jet printhead 20. The output of the "NOR" determines whether an individual jet will be activated. When the appropriate data from the data lines 32, the clock line 34, and the 12 bit wide data bus 94 are present, for example, then jet 60, jet 68, jet 76, and jet 84 will be simultaneously fired. To fire every jet several scans would be sequentially used. On the first scan, the gating circuit 22 would be programmed to first simultaneously fire the first jet in the first bank 36, the second bank 38, the third bank 40, and the fourth bank 42. On the second scan the gating circuit 22 would be programmed to simultaneously fire the second jet in the first bank 36, the second bank 38, the third bank 40, and the fourth bank 42. Succesive scans would continue in this manner until all the jets in the ink jet printhead 20 have been fired. This means that first jet 60, jet 68, jet 76, and jet 84 would be fired simultaneously. After those jets had been fired then jet 62, jet 70, jet 78, and jet 86 would be fired simultaneously. After those jets had been fired then jet 64, jet 72, jet 80, and jet 88 would be fired. The process would continue, firing groups of four jets until every jet had been fired.

The jets are fired by selection along individual lines connecting them to the decoder 48. For instance, jet 60 is fired when selected along its line 100. Likewise, jet 62 from line 102, jet 64 from line 104, jet 66 from line 106, jet 68 from line 108, jet 70 from line 110, jet 72 from line 112, jet 74 from line 114, jet 76 from line 116, jet 78 from line 118, jet 80 from line 120, jet 82 from line 122, jet 84 from line 124, jet 86 from line 126, jet 88 from line 128, and jet 90 from line 130.

It is important to notice that when a group of four jets is selected, one jet is selected from the first bank 36, one jet is selected from the second bank 38, one jet is selected from the third bank 40, and one jet is selected from the fourth bank 42 and that the chosen jets are not adjacent to each other but are widely spaced from each other across the ink jet printhead 20. While it is not critical that the chosen jets be evenly spaced from each other across the inkjet printhead 20, as in this example, it is critical that chosen jets be widely spaced from each other across the inkjet printhead 20.

Figure 1:
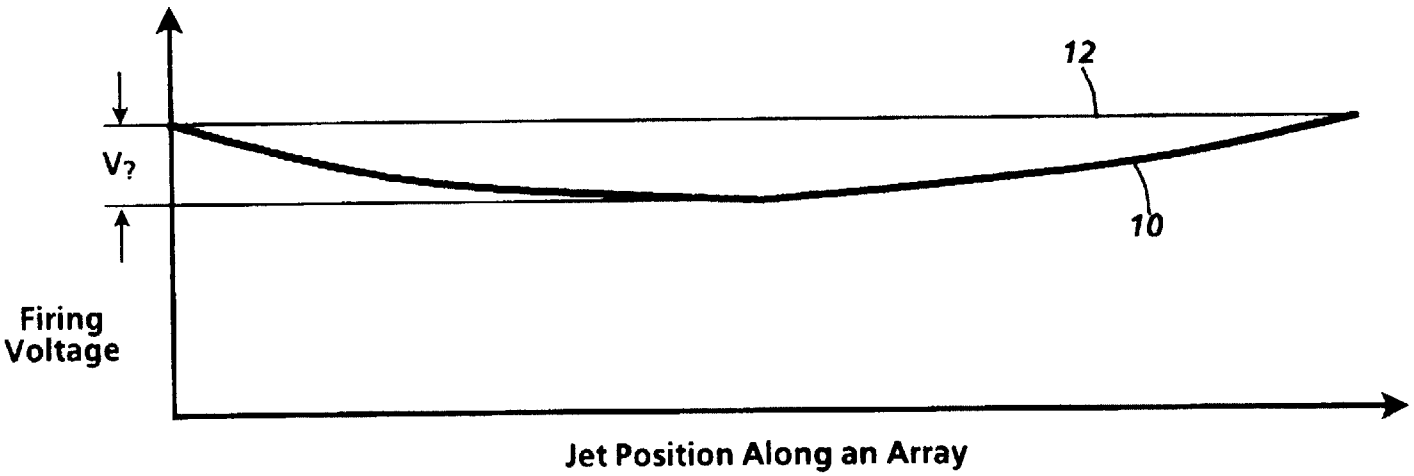
FIG. 1 is a graph of a printhead transfer curve across a conventional thermal inkjet printhead.

The inkjet printhead 20 receives power from the power circuit 50 along the line 52. Referring back to FIG. 1, the curve 10 showing a $v_{drop}$ compared to the line 12 shows typically what occurs along the line 52 providing power to the inkjet printhead 20 when jets are fired in a conventional adjacent manner. The voltage drop differential $v_{drop}$ occurs because in the conventional firing case jets are chosen for firing which are adjacent to each other. For example, four adjacent jets will require a total 1 ampere of current for firing. Resistance in the line 52 to the 1 ampere of current traveling along the line 52 causes the voltage drop differential $v_{drop}$ on the power bus as it travels along the line 52. Spacing of the firing jets insures that less than the full 1 ampere of current needed to fire four jets will be needed in the center of the line 52. Reducing the amount of current needed to travel the length of the line 52 reduces the voltage drop differential $v_{drop}$ on the bus caused by current conduction along the bus. Reduction of the voltage drop differential $v_{drop}$ causes a decrease in the smile effect, a decrease in drop size variations, an increase in the printhead lifetime.

Many different combinations of jets which space the fired jets over the entire length of the inkjet printhead 20 can be used to achieve the desired result of a reduction in $v_{drop}$ along the line 52. The M number of banks, which was chosen to be four in this example, could be any number which divides equally into the N number of jets, but is substantially smaller than the N number of jets which was chosen to be 192 in this example. As a practical matter, each bank should contain at least 4 jets. It is not necessary to limit the number of jets fired simultaneously to four as chosen in this example but larger or smaller numbers of jets fired simultaneously may be used. It is also not necessary to use an algorithm which sequences through the jets in each bank for firing. The important point is that when individual jets are chosen for simultaneous firing they are well spaced across the length of the inkjet printhead 20 to avoid a large concentration of current needed in one place on the line 52 which contributes to a voltage drop differential $v_{drop}$ on the line 52.

I claim:

1. An ink jet firing system comprising:

A) a plurality of spaced apart ink jets,

B) said plurality of ink jets being equally divided into a given number of banks wherein each bank has at least four ink jets, C) a plurality of firing groups of non-adjacent ink jets wherein each firing group includes one ink jet from each of said banks and wherein the selected ink jet from each of said banks may be selected from any of the ink jets in each of said banks, and D) means operably connected to said plurality of ink jets for selecting the ink jets in each firing group and firing each firing group independently of the other firing groups comprising:

i) a means for counting for providing a count signal, ii) a selection means operably connected to said counting means for receiving said count signal and responsive to said count signal for providing a selection signal, and iii) a firing means being operably connected to said selection means for receiving said selection signal and being responsive to said selection signal to fire said firing groups.

2. An ink jet firing system comprising:

A) a plurality of spaced apart ink jets,

B) said plurality of ink jets being equally divided into a given number of banks wherein each bank has at least four ink jets, C) a plurality of firing groups of non-adjacent ink jets wherein each firing group includes one ink jet from each of said banks and wherein the selected ink jet from each of said banks may be selected from any of the ink jets in each of said banks, and D) means operably connected to said plurality of ink jets for selecting the ink jets in each firing group and firing each firing group independently of the other firing groups comprising:

i) a counter for providing a count signal, ii) a programmable logic array operably connected to said counter for receiving said count signal and responsive to said count signal for providing a selection signal, and ii) a decoder being operably connected to said programmable logic array for receiving said selection signal and being responsive to said selection signal to fire said firing groups.

3. An ink jet firing system comprising:

A) a plurality of spaced apart ink jets,

B) said plurality of ink jets being equally divided into a given number of banks wherein each bank has at least four ink jets, C) a plurality of firing groups of non-adjacent ink jets wherein each firing group includes one ink jet from each of said banks and wherein the selected ink jet from each of said banks may be selected from any of the ink jets in each of said banks, D) a data storage means for storing data to be printed, E) firing clock means for providing a firing signal, and F) means operably connected to said plurality of ink jets for selecting the ink jets in each firing group and firing each firing group independently of the other firing groups comprising:

i) a counter being operably connected to said firing clock means for receiving said firing signal and being responsive to said firing signal for providing a count signal, ii) a programmable logic array operably connected to said counter for receiving said count signal and responsive to said count signal for providing a selection signal, and iii) a decoder being operably connected to said firing clock means for receiving said firing signal, and being operably connected to said data storage means for receiving said data and being operably connected to said programmable logic array for receiving said selection signal and being responsive to said data, said firing signal and said selection signal to fire said firing groups.

* * * * *